US005919354A

United States Patent [19]

Bartek

[11] Patent Number: 5,919,354

[45] **Date of Patent: *Jul. 6, 1999**

[54] REMOVAL OF SULFUR FROM A HYDROCARBON STREAM BY LOW SEVERITY ADSORPTION

[75] Inventor: Robert Bartek, Englewood, Colo.

[73] Assignee: Marathon Oil Company, Findlay, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/855,503

[22] Filed: May 13, 1997

[51] Int. Cl.[6] ..... C10G 25/00

[52] U.S. Cl. ..... 208/299; 208/300; 208/301; 208/310 Z; 585/820

[58] Field of Search ..... 208/299, 300, 208/208, 310 Z; 585/820

[56] References Cited

U.S. PATENT DOCUMENTS

| | | | |
|---|---|---|---|
| 3,876,532 | 4/1975 | Plundo et al. | 208/216 |
| 4,188,285 | 2/1980 | Michlmayr | 208/246 |
| 4,267,072 | 5/1981 | Vasalos | 252/455 Z |
| 4,358,297 | 11/1982 | Eberly, Jr. | 55/62 |
| 4,414,102 | 11/1983 | Rankel et al. | 208/211 |
| 4,490,045 | 10/1984 | Krishna et al. | 208/300 |
| 4,686,204 | 8/1987 | Mester et al. | 502/406 |
| 5,002,742 | 3/1991 | Lussier et al. | 423/244 |
| 5,057,473 | 10/1991 | Voecks et al. | 502/73 |
| 5,106,484 | 4/1992 | Nadler et al. | 208/299 |
| 5,114,689 | 5/1992 | Nagji et al. | 423/230 |
| 5,220,099 | 6/1993 | Schreiner et al. | 585/820 |
| 5,248,412 | 9/1993 | Fujikawa et al. | 208/299 |
| 5,300,218 | 4/1994 | Graff et al. | 208/299 |
| 5,326,462 | 7/1994 | Shih et al. | 208/89 |
| 5,401,391 | 3/1995 | Collins et al. | 208/208 R |
| 5,423,975 | 6/1995 | Sudhakar et al. | 208/216 R |
| 5,439,583 | 8/1995 | Robinson et al. | 208/62 |
| 5,454,933 | 10/1995 | Savage et al. | 208/299 |
| 5,482,617 | 1/1996 | Collins et al. | 208/227 |
| 5,507,939 | 4/1996 | Russ et al. | 208/299 |

OTHER PUBLICATIONS

Gatte, R. R., et al., "Influence of Catalyst on Sulfur Distribution in FCC Gasoline", ACS 203rd National Meeting, Apr. 1992, pp. 33–39.

Wormsbecher, R. F., et al., "Catalytic Effects on the Sulfur Distribution in FCC Fuels", National Petroleum Refiners Association Annual Meeting, Mar. 1992, pp. 1–34.

Wormsbecher, R. F., et al., "Emerging Technology for the Reduction of Sulfur in FCC Fuels", National Petroleum Refiners Association Annual Meeting, Mar. 1993, pp. 1–36.

*Primary Examiner*—Helane Myers

*Attorney, Agent, or Firm*—Jack L. Hummel; Jack E. Ebel

[57] ABSTRACT

A process is provided for reducing the sulfur content of a hydrocarbon stream, wherein a hydrocarbon stream containing sulfur constituents is contacted with a sorbent under temperature and pressure conditions of low severity. The sorbent includes a metal-exchanged zeolite selected from a group consisting of Y zeolites, ultra-stable Y zeolites, and mixtures thereof. A preferred sorbent is a fluid catalytic cracking (FCC) catalyst having a rare earth metal exchanged Y zeolite or ultra-stable Y zeolite. The sorbent adsorbs sulfur constituents contained in the hydrocarbon stream upon contact therewith to reduce the sulfur content of the hydrocarbon stream.

26 Claims, No Drawings

REMOVAL OF SULFUR FROM A HYDROCARBON STREAM BY LOW SEVERITY ADSORPTION

TECHNICAL FIELD

The present invention relates generally to treatment of a liquid hydrocarbon, and more particularly to a treatment process for reducing the sulfur content of a liquid hydrocarbon.

BACKGROUND OF THE INVENTION

Naturally-occurring sulfur constituents are commonly present in crude oils that serve as refinery feedstocks. When the feedstocks are converted at the refinery to the various refined products, many of the sulfur constituents are undesirably retained in the refined products. The presence of sulfur constituents is particularly undesirable in liquid hydrocarbon fuels because sulfur compounds are often emitted into the atmosphere as environmental pollutants upon combustion of the fuel. The presence of sulfur constituents is particularly troublesome in gasolines because nearly all gasoline-fueled automobiles in the United States employ a catalytic converter to treat the combustion off-gases from the engine and reduce the level of nitrogen oxide pollutants emitted in the off-gases. If sulfur constituents are present in the off-gases, the sulfur tends to poison the active noble metal in the emission control catalyst, rendering the catalytic converter less effective. Accordingly, it is desirable to reduce the sulfur content of liquid hydrocarbon fuels, and more generally, to reduce the sulfur content of refinery hydrocarbon streams.

Many processes are known for reducing the sulfur content of hydrocarbon streams. Most are catalytic processes performed with particular catalysts, and often performed under relatively severe conditions of temperature or pressure as exemplified by U.S. Pat. Nos. 3,876,532; 5,454,933; 5,057,473; 5,326,462; 4,188,285; 5,423,975; 5,482,617; and 5,401,391. While such processes favorably reduce the sulfur content of the treated hydrocarbon liquid, the severity of the treatment conditions can chemically alter the resulting hydrocarbon liquid in less desirable ways. Although the practitioner can attempt to mitigate the less desirable effects of the severe treatment conditions by process modifications, the effectiveness of such processes for sulfur reduction is extremely specific to the particular catalyst and/or process conditions. Thus, any significant modification of the catalyst or process conditions tends to negatively impact the effectiveness of sulfur reduction.

Fluid catalytic cracking (FCC) is a preferred process from among several conventional refining processes for producing liquid hydrocarbon fuels from refinery feedstocks. However, it has been reported that the FCC process apportions a large fraction of the sulfur constituents in the refinery feedstock to the resulting liquid hydrocarbon fuels. In particular, it has been found that FCC naphtha, a component of gasoline, contributes the largest fraction of sulfur to the total gasoline pool produced from refineries. Thus, numerous treatment options have been investigated for reducing the sulfur content of liquid hydrocarbon products from FCC units as summarized in Gatte, et al., "Influence of Catalyst on Sulfur Distribution in FCC Gasoline", American Chemical Society 203$^{rd}$ National Meeting, v. 37, n. 1, pp. 33–40, April, 1992. One treatment option is to hydrotreat the FCC feedstock or product. However, hydrotreating substantially increases the hydrogen demand for the refinery and can downgrade reformulated gasoline which is the desired FCC product. Consequently, Gatte et al. focuses on modifying the FCC process itself to reduce the sulfur content of the FCC product. Modification of the FCC process is likewise not an entirely satisfactory solution to the problem of high sulfur content in gasoline because it is relatively costly to modify the FCC process and the outcomes are uncertain.

It is apparent from the forgoing that a need exists for effectively reducing the sulfur content of a hydrocarbon stream. Accordingly, it is an object of the present invention to provide an effective process for reducing the sulfur content of a hydrocarbon stream, and particularly for reducing the sulfur content of refined liquid hydrocarbon products. More particularly, it is an object of the present invention to provide such a process for reducing the sulfur content of liquid hydrocarbon fuels such as gasolines and distillates. It is another object of the present invention to provide such a process for reducing the sulfur content of a hydrocarbon stream under relatively low severity treatment conditions. It is still another object of the present invention to provide such a process for reducing the sulfur content of a hydrocarbon stream which is relatively cost effective. It is a further object of the present invention to provide such a process for reducing the sulfur content of a hydrocarbon stream without substantially modifying existing refinery processes. These objects and others are achieved in accordance with the invention described hereafter.

SUMMARY OF THE INVENTION

The present invention is a process for reducing the sulfur content of a hydrocarbon stream. The process comprises providing a hydrocarbon stream containing naturally-occurring sulfur constituents. The hydrocarbon stream is preferably a liquid hydrocarbon selected from the group consisting of refinery feedstocks, refinery intermediates, refinery products, and mixtures thereof. Preferred refinery feedstocks to which the process applies are crude oils. Preferred refinery products to which the process applies are liquid hydrocarbon fuels having a carbon number within a range between about 5 and about 20 such as gasolines or distillates.

The selected hydrocarbon stream is contacted with a sorbent under temperature and pressure conditions of low severity. The sorbent contacting temperature is preferably not substantially greater than the reflux temperature of the hydrocarbon stream. The operating pressure and hydrogen partial pressure are both relatively low, substantially avoiding cracking of the hydrocarbon stream. The sorbent includes a natural or synthetic metal-exchanged zeolite selected from a group consisting of Y zeolites, ultra-stable Y zeolites, and mixtures thereof. The sorbent may further include a matrix of relatively inert material which is intimately mixed with the metal-exchanged zeolite. Alternatively, the sorbent may include a substrate of relatively inert material supporting the zeolite. A preferred sorbent is a fluid catalytic cracking (FCC) catalyst having a rare earth metal exchanged Y zeolite or ultra-stable Y zeolite. The FCC catalyst can be a fresh catalyst or used catalyst, with an equilibrium catalyst being the most preferred of the used catalysts because it is an effective sorbent and its use obviates the catalyst disposal problem. The equilibrium catalyst has diminished activity and has a significant loading of metal contaminants, such as iron, vanadium, nickel, copper or mixtures thereof.

The sorbent adsorbs sulfur constituents contained in the hydrocarbon stream upon contact therewith to reduce the sulfur content of the hydrocarbon stream. When the sorbent becomes saturated with sulfur constituents the sorbent is regenerated to produce a regenerated sorbent having substantially fewer of the sulfur constituents adsorbed thereon. The invention will be further understood from the accompanying description.

DESCRIPTION OF PREFERRED EMBODIMENTS

The present invention is a treatment process for reducing the sulfur content of a hydrocarbon stream. The process is initiated by providing a hydrocarbon stream containing one or more naturally-occurring sulfur constituents. The term "naturally-occurring sulfur constituents" refers to any sulfur constituents, including elemental sulfur, sulfur-containing compounds or sulfur-containing groups, which are found in crude oil when the crude oil is produced from the ground prior to processing of the crude oil. Many of these naturally-occurring sulfur constituents remain in the hydrocarbon stream during and after refining processes unless active means, such as the present process, are taken to remove the constituents.

The hydrocarbon stream of the present invention is a refinery feedstock, refinery intermediate, refinery product, or mixture thereof. Exemplary hydrocarbon streams to which the present process is applicable include crude oil feedstocks and liquid fuel products. Specific liquid fuel products are liquid hydrocarbon fuels having a carbon number within a preferred range between about 5 and about 20, including full range gasoline and distillates. The naturally-occurring sulfur constituents contained within the hydrocarbon stream typically include mercaptans, disulfides, sulfides or thoiphenes.

In accordance with the present process, the hydrocarbon stream is contacted with a sorbent capable of adsorbing at least a portion of the sulfur constituents contained in the hydrocarbon stream. The sorbent comprises an active component in the form of a zeolite, typically in a finely divided solid state such as a powder. Zeolites are generally characterized as naturally-occurring or synthetic crystalline aluminosilicates of Group IA and Group IIA elements, such as hydrogen, sodium, potassium, magnesium and calcium. The generalized structural formula for a single crystal unit cell of a zeolite is:

$$M_{x/n}[(AlO_2)_x(SiO_2)_y].wH_2O$$

where n is the valence of the Group IA or Group IIA cation M, w is the number of water molecules per unit cell, x and y are the total number of tetrahedral per unit cell, and y/x (termed the silica to alumina ratio) usually has values of 1 to 100 or higher. Specific families of zeolites include Y zeolites and ultra-stable Y zeolites. A Y zeolite is defined herein as a zeolite having a silica to alumina ratio between about 1.5:1 and about 5:1. An ultra-stable Y zeolite is defined herein as a zeolite having a silica to alumina ratio greater than about 5:1.

A faujasite is an exemplary Y zeolite, wherein y/x approaches 3. Typical faujasites have the generalized structural formula:

$$(Ca,Mg,Na_2,K_2)_{29.5}[(AlO_2)_{59}(SiO_2)_{133}].235H_2O$$

Another exemplary Y zeolite is a synthetic zeolite, wherein y/x approaches 3, having the generalized structural formula:

$$Na_{56}[(AlO_2)_{56}(SiO_2)_{136}].250H_2O$$

A metal-exchanged zeolite is a zeolite wherein one or more metal cations, imparting additional catalytic activity and/or stability to the zeolite, are exchanged for at least a portion of the Group IA or Group IIA cations.

Zeolites having utility herein are metal-exchanged zeolites of either synthetic or naturally-occurring zeolites. The metal-exchanged zeolite is preferably selected from a group consisting of Y zeolites, ultra-stable Y zeolites, and mixtures thereof.

The metal-exchanged forms of the above-recited zeolites are typically created in a multi-step process by exchanging the bulk of the non-hydrogen Group IA or Group IIA cations in the zeolite with hydrogen cations using ammonia. At least a portion of the hydrogen cations and/or any other remaining Group IA or Group IIA cations in the zeolite are then exchanged with one or more catalytically active and/or stability inducing metal cations to enhance the catalytic activity and/or stability of the resulting metal-exchanged zeolite. Preferred among these metal cations are the rare earth metal cations. Other such metal cations having utility herein include palladium and platinum cations.

In accordance with one embodiment of the invention, the active component constitutes substantially the entire sorbent. In an alternate embodiment of the present invention, the sorbent comprises the above-recited active component and a matrix that is relatively inert with the hydrocarbon stream and with the active component of the sorbent. The matrix is a finely divided solid material intimately mixed with the active component in an unconsolidated mixture. Exemplary matrix materials include clay, alumina, silica/alumina and mixtures thereof. In yet another embodiment of the invention, the sorbent comprises the above-recited active component and a solid substrate having a surface supporting the active component. The substrate is preferably formed from a relatively inert material such as one of the above-recited matrix materials.

Sorbents satisfying the above-recited criteria are fluid catalytic cracking (FCC) catalysts. The active component of the FCC catalyst is typically a finely divided rare earth metal exchanged zeolite powder bound to a relatively inert substrate comprised of clay, alumina, silica/alumina or mixtures thereof. The concentration of active zeolite in the FCC catalyst is commonly in a range between about 20 and 50 weight %.

FCC catalysts having utility herein include fresh and used FCC catalysts. Preferred from among these catalysts are equilibrium FCC catalysts. As defined herein, a fresh FCC catalyst is a new catalyst that has not been used in an FCC process. An equilibrium FCC catalyst is a used FCC catalyst that has been withdrawn from an FCC process and thermally regenerated to burn off carbon deposits. The equilibrium FCC catalyst has diminished catalytic cracking activity relative to the fresh FCC catalyst. Fresh FCC catalysts typically have a catalytic cracking activity exceeding about 80% conversion, whereas equilibrium FCC catalysts typically having a catalytic cracking activity below about 75% conversion and have a significant loading of metal contaminants from the FCC process. Such metal contaminants include iron, vanadium, nickel, copper and mixtures thereof. The metal contaminant loadings on the equilibrium FCC catalyst are a function of the FCC process conditions and the hydrocarbon feedstock. Generally the combined nickel and vanadium loading is in a range from about 2,000 to about 10,000 ppm. Iron loading is on the order of about 0.5 weight %.

In a typical FCC process, a portion of the equilibrium FCC catalyst is returned to the FCC process after regeneration as a recycle stream and the remainder of the equilibrium FCC catalyst is discarded as a waste FCC catalyst, being replaced in the FCC process by fresh FCC catalyst. Such waste FCC catalysts have preferred utility in the process of the present invention because their use obviates the catalyst disposal problem.

Contacting the hydrocarbon stream with the sorbent is effected in a reaction vessel containing either a fixed bed or a fluidized bed of the sorbent. The reaction vessel is maintained at temperature and pressure conditions of relatively low severity. As such the sorbent contacting temperature for the process is relatively low, preferably not being substantially greater than the reflux temperature of the hydrocarbon stream being treated. The reflux temperature of distillates is typically about 260° C. and the reflux temperature of gasolines is typically about 93° C. Accordingly, treatment of a gasoline is preferably performed at a sorbent contacting temperature not substantially greater than about 93° C., while treatment of a distillate is preferably performed at an absorbent contacting temperature not substantially greater than about 260° C. The sorbent contacting pressure for the process is likewise relatively low, being preferably within a range from about 0 to about 698 kPa. Contacting the hydrocarbon stream with the sorbent is preferably performed substantially in the absence of oxygen and hydrogen or at a relatively low hydrogen partial pressure less than about 175 kPa. A preferred reaction environment is a reducing environment or a nitrogen environment, which is relatively inert.

Although the process of the present invention is not limited to a particular mechanism, it is believed that the primary mechanism for removal of the sulfur constituents from the hydrocarbon stream is by adsorption under the above-recited conditions of low severity. The low severity conditions are believed to generally avoid cracking or other chemical reactions in the hydrocarbon stream.

Upon saturation of the sorbent with sulfur constituents from the hydrocarbon stream, the sorbent is subjected to a regeneration stage. Regeneration of the sorbent is effected by heating the sorbent to a regeneration temperature while initially passing a stream of an inert gas through the sorbent and thereafter passing a stream of an oxidative gas, such as air, or a reductive gas, such as hydrogen, through the sorbent under conditions within the purview of the skilled artisan. The sulfur constituents on the sorbent are thereby converted to sulfur oxides and/or $H_2S$ and driven from the sorbent for subsequent recovery. The resulting regenerated sorbent is returned to treatment of the hydrocarbon stream.

The following examples demonstrate the scope and utility of the present invention, but are not to be construed as limiting the scope thereof.

EXAMPLE 1

An equilibrium FCC catalyst is provided containing a rare earth metal-exchanged ultra-stable Y zeolite (USY). The equilibrium FCC catalyst is derived from a fresh FCC catalyst available under the tradename SUPER NOVA D from W. R. Grace & Co., P.O. Box 2117, Baltimore, Md. 21203-2117. The fresh FCC catalyst has the following properties:

average particle size: 81 microns bulk density: 0.83 g/cm$^3$ alumina content: 35.7 wt % total surface area: 268 m$^2$/g zeolite surface area: 180 m$^2$/g matrix surface area: 88 m$^2$/g zeolite unit cell size: 24.55 angstroms rare earth content of zeolite (based on oxide form): 2.1 wt %

The equilibrium FCC catalyst has the following properties after use in an FCC process:

total surface area: 167 m$^2$/g zeolite unit cell size: 24.30 angstroms 25 g of the equilibrium FCC catalyst and 50 cm$^3$ (42.57 g) of a sour distillate are combined in a slurry and placed in a standard 250 cc 3 neck reflux apparatus. The slurry is heated from room temperature (25° C.) to the reflux temperature of 260° C. in 20 minutes, maintained at the reflux temperature for 1 hour, and cooled back down to room temperature, all at ambient pressure. The catalyst and distillate are separated from one another by filtration.

The distillate turns from a dark yellow to a bright yellow. The sulfur concentration of the untreated and treated distillate is measured by XRF and reported as follows:

Distillate $S_{in}$=1.42 wt %

Distillate $S_{out}$=1.20 wt %

Accordingly, the treatment process of the present invention results in a 15.5 wt % sulfur reduction in the treated distillate.

EXAMPLE 2

25 g of a fresh FCC catalyst, from which the equilibrium FCC catalyst of Example 1 is derived, and 50 cm$^3$ (43.035 g) of the distillate of Example 1 are combined in a slurry and placed in the reflux apparatus of Example 1. The slurry is heated from room temperature to the reflux temperature of 252° C. in 20 minutes, maintained at the reflux temperature for 1 hour, and cooled back down to room temperature, all at ambient pressure. The catalyst and distillate are separated from one another by filtration.

The catalyst turns dark brown while the distillate turns from a dark yellow to a very light yellow. The sulfur concentration of the untreated and treated distillate is measured by XRF and reported as follows:

Distillate $S_{in}$=1.42 wt %

Distillate $S_{out}$=0.810 wt %

Accordingly, the treatment process results in a 43.0 wt % sulfur reduction in the treated distillate.

EXAMPLE 3

An equilibrium FCC catalyst is provided containing a USY. The equilibrium FCC catalyst is derived from a fresh FCC catalyst available under the tradename REDUXION 5ORVS from Engelhard Corp., 101 Wood Ave., Iselin, N.J. 08830-0770. The fresh FCC catalyst has the following properties:

average particle size: 72 microns bulk density: 0.86 g/cm$^3$ alumina content: 30.2 wt % total surface area: 305 m$^2$/g zeolite surface area: 209 m$^2$/g matrix surface area: 96 m$^2$/g zeolite unit cell size: 24.49 angstroms rare earth content of zeolite (based on oxide form): 0.6 wt %

The equilibrium FCC catalyst has the following properties after use in an FCC process:

total surface area: 138 m$^2$/g zeolite unit cell size: 24.27 angstroms 25 g of the equilibrium FCC catalyst and 50 cm$^3$ (41.61 g) of the distillate of Example 1 are combined in a slurry and placed in the reflux apparatus of Example 1. The slurry is heated from room temperature to the reflux temperature of 262° C. in 20 minutes, maintained at the reflux temperature for 1 hour, and cooled back down to room temperature, all at ambient pressure. The catalyst and distillate are separated from one another by filtration.

The catalyst does not exhibit significant visible change in color. The sulfur concentration of the untreated and treated distillate is measured by XRF and reported as follows:

Distillate $S_{in}$=1.42 wt %

Distillate $S_{out}$=1.21 wt %

Accordingly, the treatment process results in a 14.8 wt % sulfur reduction in the treated distillate.

EXAMPLE 4

25 g of a fresh FCC catalyst, from which the equilibrium FCC catalyst of Example 3 is derived, and 50 $cm^3$ (41.61 g) of the distillate of Example 1 are combined in a slurry and placed in the reflux apparatus of Example 1. The slurry is heated from room temperature to the reflux temperature of 252° C. in 20 minutes, maintained at the reflux temperature for 1 hour, and cooled back down to room temperature, all at ambient pressure. The catalyst and distillate are separated from one another by filtration.

The catalyst turns dark brown while the distillate turns from a dark yellow to a light yellow. The sulfur concentration of the untreated and treated distillate is measured by XRF and reported as follows:

Distillate $S_{in}$=1.42 wt %

Distillate $S_{out}$=0.72 wt %

Accordingly, the treatment process results in a 49.3 wt % sulfur reduction in the treated distillate.

EXAMPLE 5

An equilibrium FCC catalyst is provided containing a USY. The equilibrium FCC catalyst is derived from a fresh FCC catalyst available under the tradename MGB-3 from Akzo Chemicals, Inc., 2625 Bay Blvd., Suite 250, Houston, Tex. 77058. The fresh FCC catalyst has the following properties:

average particle size: 72 microns bulk density: 0.71 g/$cm^3$ alumina content: 36.6 wt % total surface area: 326 $m^2$/g zeolite surface area: 183 $m^2$/g matrix surface area: 143 $m^2$/g zeolite unit cell size: 24.51 angstroms rare earth content of zeolite (based on oxide form): 0.36 wt %

The equilibrium FCC catalyst has the following properties after use in an FCC process:

total surface area: 214 $m^2$/g zeolite unit cell size: 24.25 angstroms 25 g of the equilibrium FCC catalyst and 50 $cm^3$ (41.61 g) of the distillate of Example 1 are combined in a slurry and placed in the reflux apparatus of Example 1. The slurry is heated from room temperature to the reflux temperature of 257° C. in 20 minutes, maintained at the reflux temperature for 1 hour, and cooled back down to room temperature, all at ambient pressure. The catalyst and distillate are separated from one another by filtration.

The catalyst turns somewhat brighter in color. The sulfur concentration of the untreated and treated distillate is measured by XRF and reported as follows:

Distillate $S_{in}$=1.42 wt %

Distillate $S_{out}$=1.21 wt %

Accordingly, the treatment process results in a 14.8 wt % sulfur reduction in the treated distillate.

EXAMPLE 6

25 g of a fresh FCC catalyst, from which the equilibrium catalyst of Example 5 is derived, and 50 $cm^3$ (41.61 g) of the distillate of Example 1 are combined in a slurry and placed in the reflux apparatus of Example 1. The slurry is heated from room temperature to the reflux temperature of 251 ° C. in 20 minutes, maintained at the reflux temperature for 1 hour, and cooled back down to room temperature, all at ambient pressure. It is noted that the variability between Examples 1–6 in the reflux temperature is primarily attributable to variability in the ambient atmospheric pressure. The catalyst and distillate are separated from one another by filtration.

The catalyst turns dark brown while the treated distillate becomes significantly lighter in color. The sulfur concentration of the untreated and treated distillate is measured by XRF and reported as follows:

Distillate $S_{in}$=1.42 wt %

Distillate $S_{out}$=0.68 wt %

Accordingly, the treatment process results in a 52.1 wt % sulfur reduction in the treated distillate.

EXAMPLE 7

25 g of the fresh FCC catalyst of Example 6 and 50 $cm^3$ of a heavy cat naphtha are combined in a slurry and placed in the reflux apparatus of Example 1. The slurry is heated from room temperature to the reflux temperature of 207° C. in 20 minutes, maintained at the reflux temperature for 1 hour, and cooled back down to room temperature, all at ambient pressure. The catalyst and naphtha are separated from one another by filtration.

The catalyst turns from a sand color to a deep purple. The sulfur concentration of the untreated and treated naphtha is measured by XRF and reported as follows:

Naphtha $S_{in}$=0.55 wt %

Naphtha $S_{out}$=0.46 wt %

Accordingly, the treatment process results in a 16.4 wt % sulfur reduction in the treated naphtha.

EXAMPLE 8

25 g of the equilibrium FCC catalyst of Example 5 and 50 $cm^3$ of the naphtha of Example 7 are combined in a slurry and placed in the reflux apparatus of Example 1. The slurry is heated from room temperature to the reflux temperature of 207° C. in 20 minutes, maintained at the reflux temperature for 1 hour, and cooled back down to room temperature, all at ambient pressure. The catalyst and naphtha are separated from one another by filtration.

The catalyst turns darker. The sulfur concentration of the untreated and treated naphtha is measured by XRF and reported as follows:

Naphtha $S_{in}$=0.55 wt %

Naphtha $S_{out}$=0.54 wt %

Accordingly, the treatment process results in a 2 wt % sulfur reduction in the treated naphtha.

EXAMPLE 9

25 g of the equilibrium FCC catalyst of Example 5 and 50 $cm^3$ of the naphtha of Example 7 are combined in a slurry and placed in the reflux apparatus of Example 1. The slurry is heated from room temperature to a temperature below the reflux temperature of 93° C. in 20 minutes, maintained at this temperature for 1 hour, and cooled back down to room temperature, all at ambient pressure. The catalyst and naphtha are separated from one another by filtration.

The sulfur concentration of the untreated and treated naphtha is measured by XRF and reported as follows:

Naphtha $S_{in}$=0.55 wt %

Naphtha $S_{out}$=0.51 wt %

Accordingly, the treatment process results in a 7.3 wt % sulfur reduction in the treated naphtha.

EXAMPLE 10

25 g of the equilibrium FCC catalyst of Example 1 and 50 $cm^3$ of the naphtha of Example 7 are combined in a slurry and placed in the reflux apparatus of Example 1. The slurry is heated from room temperature to a temperature below the reflux temperature of 93° C. in 20 minutes, maintained at this temperature for 1 hour, and cooled back down to room temperature, all at ambient pressure. The catalyst and naphtha are separated from one another by filtration.

The catalyst turns purple. The sulfur concentration of the untreated and treated naphtha is measured by XRF and reported as follows:

Naphtha $S_{in}$=0.55 wt %

Naphtha $S_{out}$=0.51 wt %

Accordingly, the treatment process results in a 7.3 wt % sulfur reduction in the treated naphtha.

EXAMPLE 11

25 g of the fresh FCC catalyst of Example 2 and 50 $cm^3$ of the naphtha of Example 7 are combined in a slurry and placed in the reflux apparatus of Example 1. The slurry is heated from room temperature to a temperature below the reflux temperature of 93° C. in 20 minutes, maintained at this temperature for 1 hour, and cooled back down to room temperature, all at ambient pressure. The catalyst and naphtha are separated from one another by filtration.

The catalyst turns dark purple. The sulfur concentration of the untreated and treated naphtha is measured by XRF and reported as follows:

Naphtha $S_{in}$=0.55 wt %

Naphtha $S_{out}$=0.47 wt %

Accordingly, the treatment process results in a 14.5 wt % sulfur reduction in the treated naphtha.

While the foregoing preferred embodiments of the invention have been described and shown, it is understood that alternatives and modifications, such as those suggested and others, may be made thereto and fall within the scope of the present invention.

I claim:

1. A process for reducing the sulfur content of a hydrocarbon stream under temperature and pressure conditions of low severity comprising:

providing a hydrocarbon stream containing a sulfur constituent;

heating said hydrocarbon stream to a contacting temperature greater than ambient, but not greater than the reflux temperature of said hydrocarbon stream;

contacting said heated hydrocarbon stream at said contacting temperature and at a contacting pressure not greater than about 698 kPa with a sorbent including a metal-exchanged zeolite having a silica to alumina ratio of at least about 1.5:1; and adsorbing said sulfur constituent contained in said hydrocarbon stream onto said sorbent to reduce the sulfur content of said hydrocarbon stream.

2. The process of claim 1 wherein said metal-exchanged zeolite is selected from a group consisting of Y zeolites, ultra-stable Y zeolites, and mixtures thereof.

3. The process of claim 1 wherein said hydrocarbon stream is a liquid hydrocarbon selected from the group consisting of refinery feedstocks, refinery intermediates, refinery products, and mixtures thereof.

4. The process of claim 1 wherein said hydrocarbon stream is a liquid hydrocarbon fuel having a carbon number within a range between about 5 and about 20.

5. The process of claim 1 wherein said sulfur constituent is naturally-occurring in said hydrocarbon stream.

6. The process of claim 1 wherein said metal-exchanged zeolite is a rare earth metal-exchanged zeolite.

7. The process of claim 1 wherein said sorbent is a fresh or used fluid catalytic cracking catalyst.

8. The process of claim 7 wherein said used fluid catalytic cracking catalyst is an equilibrium fluid catalytic cracking catalyst.

9. The process of claim 1 wherein said sorbent includes a matrix of relatively inert material.

10. The process of claim 9 wherein said relatively inert material is selected from a group consisting of clay, alumina and silica/alumina.

11. The process of claim 9 wherein said matrix is intimately mixed with said zeolite.

12. The process of claim 1 wherein said sorbent includes a substrate supporting said zeolite.

13. The process of claim 1 further comprising regenerating said sorbent having said sulfur constituent adsorbed thereon to produce a regenerated sorbent having substantially less of said sulfur constituent adsorbed thereon.

14. The process of claim 1 wherein said zeolite has a loading of a metal contaminant selected from a group consisting of iron, vanadium, nickel, copper and mixtures thereof.

15. The process of claim 1 wherein said hydrocarbon stream is contacted with said sorbent in the absence of oxygen.

16. The process of claim 1 wherein said sulfur constituent is selected from a group consisting of mercaptans, disulfides, sulfides, thiophene and mixtures thereof.

17. A process for reducing the sulfur content of a hydrocarbon stream under temperature and pressure conditions of low severity comprising:

providing a hydrocarbon stream containing a sulfur constituent;

heating said hydrocarbon stream to a contacting temperature greater than ambient, but not greater than the reflux temperature of said hydrocarbon stream;

contacting said heated hydrocarbon stream at said contacting temperature and at a contacting pressure not greater than about 698 kPa with a fluid catalytic cracking catalyst including a rare earth metal-exchanged zeolite having a silica to alumina ratio of at least about 1.5:1; and adsorbing said sulfur constituent contained in said hydrocarbon stream onto said fluid catalytic cracking catalyst acting as a sorbent to reduce the sulfur content of said hydrocarbon stream.

18. The process of claim 17 wherein said rare earth metal-exchanged zeolite is selected from a group consisting of Y zeolites, ultra-stable Y zeolites, and mixtures thereof.

19. The process of claim 17 wherein said hydrocarbon stream is a liquid hydrocarbon selected from the group consisting of refinery feedstocks, refinery intermediates, refinery products, and mixtures thereof.

20. The process of claim 17 wherein said hydrocarbon stream is a liquid hydrocarbon fuel having a carbon number within a range between about 5 and about 20.

21. The process of claim 17 further comprising regenerating said sorbent having said sulfur constituent adsorbed thereon to produce a regenerated sorbent having substantially less of said sulfur constituent adsorbed thereon.

22. The process of claim 17 wherein said hydrocarbon stream is contacted with said sorbent in the absence of oxygen.

23. The process of claim 17 wherein said sulfur constituent is naturally-occurring in said hydrocarbon stream.

24. The process of claim 17 wherein said fluid catalytic cracking catalyst is an equilibrium fluid catalytic cracking catalyst.

25. The process of claim 17 wherein said sulfur constituent is selected from a group consisting of mercaptans, disulfides, sulfides, thiophene and mixtures thereof.

26. A process for reducing the sulfur content of a hydrocarbon stream under temperature and pressure conditions of low severity comprising:

providing a hydrocarbon stream containing a sulfur constituent selected from a group consisting of mercaptans, disulfides, sulfides, thiophene and mixtures thereof;

heating said hydrocarbon stream to a contacting temperature greater than ambient, but not greater than the reflux temperature of said hydrocarbon stream;

contacting said heated hydrocarbon stream with a metal-exchanged zeolite selected from a group consisting of Y zeolites, ultra-stable Y zeolites, and mixtures thereof at said contacting temperature and at a contacting pressure not greater than about 698 kPa, wherein said metal-exchanged zeolite has an exchanged metal cation selected from a group consisting of rare earth metal cations, palladium cations, platinum cations and mixtures thereof; and adsorbing said sulfur constituent contained in said hydrocarbon stream onto said metal-exchanged zeolite to reduce the sulfur content of said hydrocarbon stream.

* * * * *